US007980256B2

(12) United States Patent
Hartvigsson

(10) Patent No.: US 7,980,256 B2
(45) Date of Patent: Jul. 19, 2011

(54) FILTER SYSTEM FOR A HOUSEHOLD DISHWASHER

(75) Inventor: Marcus Hartvigsson, Varnamo (SE)

(73) Assignee: Electrolux Home Products Corporation N.V., Zaventem (BE)

( * ) Notice: Subject to any disclaimer, the term of this patent is extended or adjusted under 35 U.S.C. 154(b) by 933 days.

(21) Appl. No.: 10/550,386

(22) PCT Filed: Apr. 2, 2004

(86) PCT No.: PCT/SE2004/000527

§ 371 (c)(1),
(2), (4) Date: Jun. 21, 2006

(87) PCT Pub. No.: WO2004/096005

PCT Pub. Date: Nov. 11, 2004

(65) Prior Publication Data

US 2007/0000525 A1 Jan. 4, 2007

(30) Foreign Application Priority Data

Apr. 25, 2003 (SE) ..... 0301209

(51) Int. Cl.
*B08B 3/00* (2006.01)

(52) U.S. Cl. ..... 134/111; 134/56 D

(58) Field of Classification Search ..... 134/56 R, 134/57 D, 58 D, 104.1, 104.4, 111
See application file for complete search history.

(56) References Cited

U.S. PATENT DOCUMENTS 5,609,172 A 3/1997 Chang et al.
5,660,195 A * 8/1997 Taylor et al. ..... 134/58 D
5,937,879 A 8/1999 Payzant

* cited by examiner

*Primary Examiner* — Michael Barr
*Assistant Examiner* — David Cormier
(74) *Attorney, Agent, or Firm* — Pearne & Gordon LLP

(57) ABSTRACT

This invention relates to a filter system for a household dishwasher comprising a wash space and a liquid circuit that comprises a coarse sieve (33) and one or several fine filters (18, 19). The coarse sieve (33) is movable between at least two positions with the aid of means (29, 31) arranged in the dishwasher. A part of the circulating liquid in the first position (FIG. 3) flows through a collecting part (34) of the coarse sieve (33) whereas the circulating liquid in the second position (FIG. 4) flows outside said collecting part.

10 Claims, 2 Drawing Sheets

FILTER SYSTEM FOR A HOUSEHOLD DISHWASHER

This application claims the benefit of International Application Number PCT/SE2004/000527, which was published in English on Nov. 11, 2004.

This invention relates to a filter system for a household dishwasher comprising a wash space and a liquid circuit that comprises a coarse sieve and one or several fine filters the coarse sieve being movable between at least two positions with the aid of actuating means arranged in the dishwasher.

Filter systems for conventional dishwashers usually comprise a coarse sieve in which larger details are collected and different types of fine filters or micro filters in which finer particles are trapped. The coarse sieve usually is a comparatively small cup shaped strainer hidden in a recess surrounded by a fine filter at the trough shaped bottom part of the wash chamber. This means that the collecting volume of the coarse sieve is small and that the circulating liquid flows through the dirt and soil trapped in the coarse sieve during the cleaning phase as well as under the rinsing phase. Thus, particles coming from the collected material in the coarse sieve might re-deposit and contaminate the dish during the rinsing phase. Because the small volume of the coarse sieve the sieve quickly gets filled if the dish is inserted into the wash chamber without being pre-washed. In order to avoid this people usually wash the dish under flushing water before putting it into the machine thereby increasing the water consumption and the energy consumption if hot water is used. Since the traditional coarse sieves are hidden at the bottom part of the wash chamber it is also usually hard for the operator to see the filling state of the coarse sieve.

In order to drain out all soiled water before rinse water is taken in it is also previously known, see U.S. Pat. No. 5,937,879, to use a coarse sieve that to some extent is lifted up during the rinse phase together with a plug that normally closes the drain opening. Since water flows through the coarse sieve in the lower as well as the upper position the risk for contaminating the dish in the rinsing phase is the same as has been described above.

The purpose of this invention is to create a new filter system making it possible to put the dish into the wash chamber without pre-washing it under flushing water and also to decrease the risk for contaminating the dish during the rinsing stage. A further purpose is to create a system that visualizes the filling state of the coarse sieve making it possible for the operator to easily see when the coarse sieve has to be emptied. This is achieved by means of a device having the characteristics mentioned in the claims.

Figure 1:
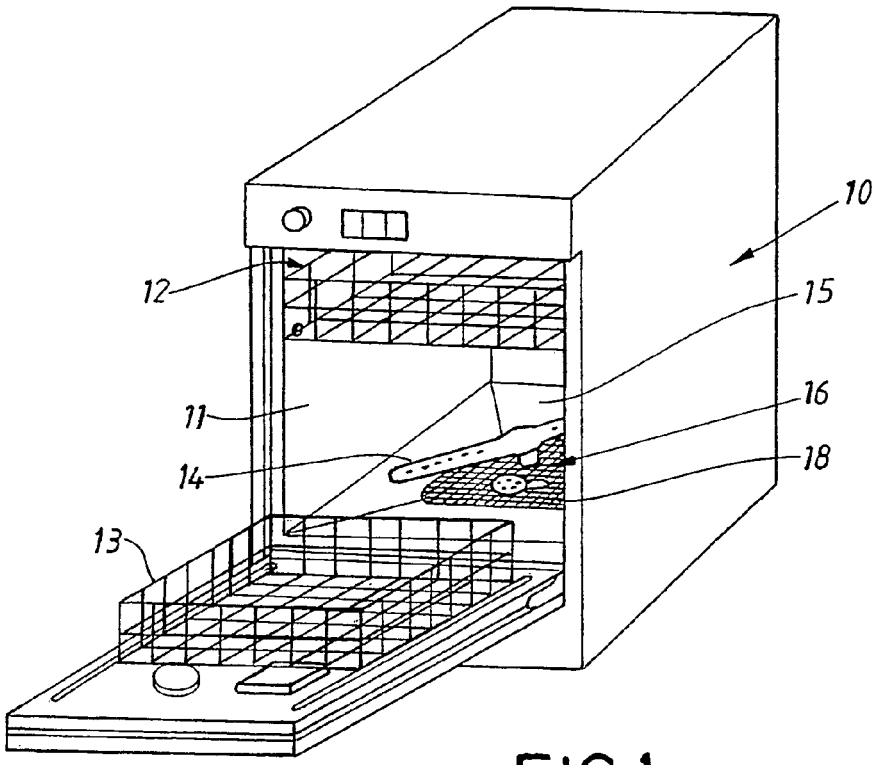
Figure 2:
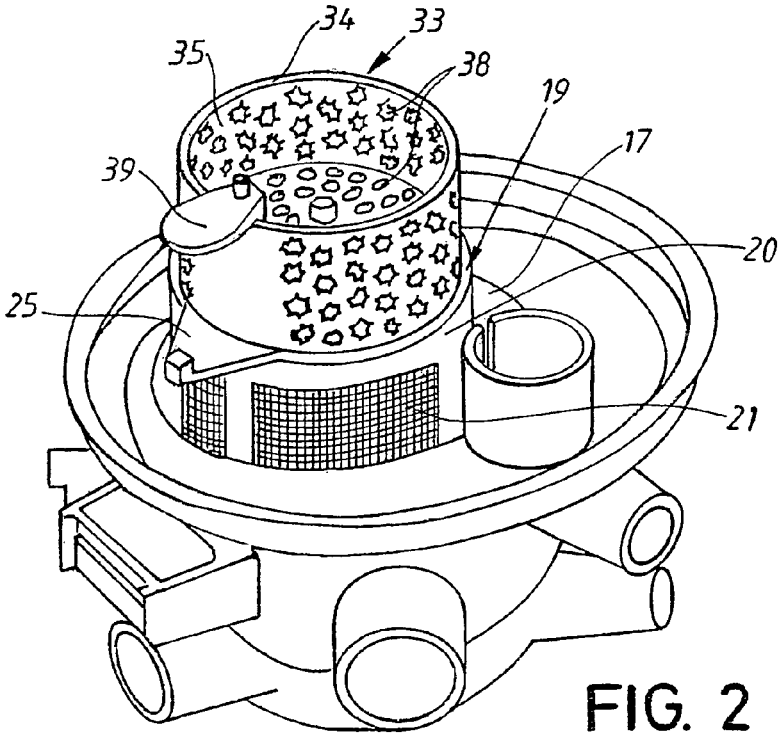
Figure 3:
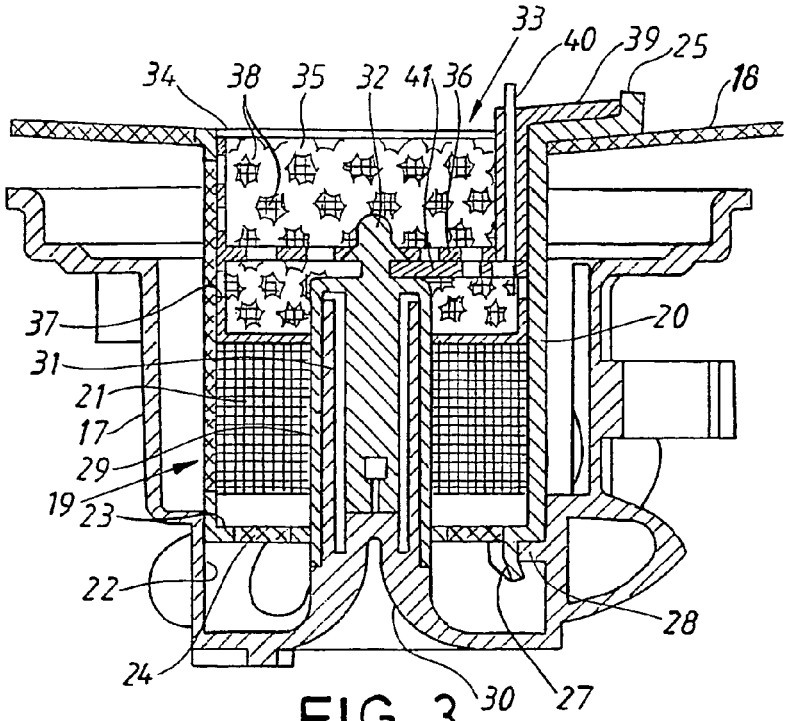
Figure 4:
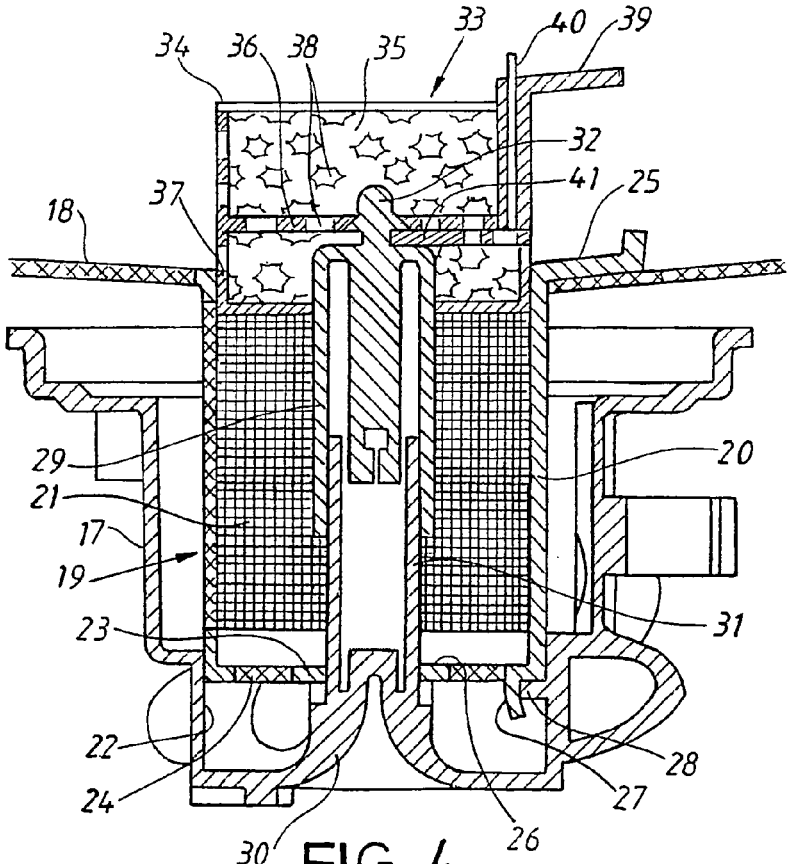

An embodiment of the invention will now be described with reference to the accompanying drawing on which FIG. 1 is a perspective view of a dishwasher according to the invention, FIG. 2 is a perspective view of an uncovered part of the filter arrangement in the dishwasher, FIG. 3 is a vertical section through the filter arrangement shown in FIG. 2 with a coarse sieve in a first hidden position whereas FIG. 4 is a the same section as FIG. 3 but with the coarse sieve in a second visible position.

FIG. 1 shows a dishwasher 10 that is provided with a wash space 11 in which dish is inserted on an upper and a lower basket 12, 13. In the wash space there is an upper (not shown) and a lower rotating spray arm 14 that directs the circulating liquid through spray nozzles towards the dish which is placed on the baskets 12,13. The circulating liquid falls down on the bottom 15 of the wash space 11 and is directed towards a filter arrangement 16 that covers a liquid collecting container 17 (see FIGS. 3 and 4) from which the liquid by means of a circulation pump (not shown) is distributed to the spray arms.

The filter arrangement 16 comprises a fine filter plate 18 that covers a rather large, mainly horizontal area and is arranged above the container 17. The container 17 supports a cup shaped, fine filter 19 comprising a tubular plastic frame 20 with large openings 21 covered by the fine filter material. The frame 20 is partly inserted into a tubular recess 22 at the lower end of the collecting container and has a bottom 23 provided with openings 24 covered by the same filter material. The upper end of the frame, which is mainly flush with the upper surface of the fine filter plate 18, has a handle 25 resting against said surface whereas the bottom 23 is provided with a central opening 26 and a projecting lip 27 cooperating with a shoulder 28 in order to keep the frame 20 in place in the machine.

The central opening 26 surrounds a piston 29 that extends upwards from a bottom 30 of the container and that cooperates with a cylinder 31. The cylinder/piston actuating arrangement 29,31, which is activated or deactivated by the program control, is a so called wax actuator in which a soft mass trapped in the cylinder is expanded when being heated. The wax actuator co-operates with a spring (not shown) that lifts the piston whereas the wax actuator pulls a wire to lower the piston.

The upper part of the piston 29 is provided with a clamp means 32 on which a coarse sieve 33 is removably secured. The sieve 33 which preferably is made of plastic material comprises an upper cup shaped part 34 having a tubular wall 35 with an outer diameter slightly less than the inner diameter of the filter 19. The tubular wall 35 extends below an intermediate wall 36 that constitutes a bottom of the cup shaped part 34 and forms a skirt 37. The tubular wall 35, the skirt 37 and the intermediate wall 36 are provided with comparatively large openings 38 forming the filtering areas of the sieve. The sieve is also provided with a handle 39 and the intermediate wall 36 has a central opening cooperating with the clamp means 32 to keep the sieve in removable engagement with the piston 29. To lock the sieve 33 at the clamp means 32 there is a vertical elongated rod 40 whose upper end extends up above the handle 39 and whose lower end co-operates with a spring loaded locking bar 41. By depressing the rod 40 the sieve 33 is disengaged from the piston 29 and when the sieve is again placed on the piston the locking bar 41 again locks the sieve to the clamping means.

The device operates in the following manner. When dish is placed in the wash space 11 and cleaning liquid starts to circulate through the spray arms 14 the dirt is flushed from the dish and is distributed to the fine filter plate 18. A part of the liquid flows through the filter plate 18 into the container 17 whereas the main part of the soil together with the remaining part of the circulating liquid successively flows over the upper edge of the coarse strainer 33 which during the cleaning phase is in its lower position, see FIG. 3. This means that larger particles and details are collected in the cup shaped part 34 whereas the liquid flows through the filter material in the openings 21 of the filter 19 into the bottom part of the container 17 from which the liquid is distributed to the spray arms by means of the circulation pump.

When the cleaning phase has been finished the program control activates the cylinder/piston arrangement 29,31 which means that the piston rises the thereby bringing the coarse sieve 33 to the visible position shown in FIG. 4. In this position the skirt 37 still serves as a coarse sieve for the rinsing water flowing from the filter plate 18 into the interior of the filter 19 and further to the lower part of the container 17 whereas the cup shaped part 34 in this position is placed above the water flow. Consequently there will be no re-deposition of particles on the dish from the dirt that has been collected in the cup shaped part 34 during the rinsing stage.

The coarse sieve 33 is kept in the upper position until the next dish starts. When the operator opens the door of the dishwasher the coarse sieve is clearly visible and the coarse sieve can easily be disengaged from the clamp means 32 of the piston 29 by depressing the rod 40 at the handle 39. The sieve can then be emptied into a bin before it is again replaced on the clamp means. At the same time the fine filter 19 might be removed and cleaned as well as the filter plate 18. When a new dish starts the coarse sieve will be withdrawn and automatically return to its lower position.

It should be stressed that it of course is possible to use different kind arrangements instead of the wax actuator mentioned above to achieve the movement of the coarse sieve, for instance an electric motor, a spring, a solenoid or the water pressure from the circulation pump. It is also possible to connect the movement of the coarse sieve to the opening movement of the door in order to get the visible effect or to use other means in the dishwasher to cause the lifting movement when initiated by the operator in order to make it easier to remove the coarse sieve from the machine.

The invention claimed is:

1. Filter system for a household dishwasher comprising a wash space (11), the filter system comprising an actuating means and a liquid circuit that comprises a coarse sieve (33) having a collecting part (34) and one or several fine filters (18, 19), the coarse sieve (33) being movable between a first position and a second position with the aid of the actuating means (29, 31) arranged in the dishwasher wherein when the coarse sieve (33) is in the first position, the collecting part (34) is positioned within a flow of rinsing liquid such that the rinsing liquid can flow through the coarse sieve, and wherein when the coarse sieve (33) is in the second position, the collecting part (34) is positioned above the one or several fine filters (18, 19), and wherein the actuating means is activated and deactivated by a program control such that the program control moves the coarse sieve to and from the first position and the second position.

2. Filter system according to claim 1 characterized in that the coarse sieve (33) is in the first position during the main part of the cleaning phase whereas the coarse sieve is in the second position during the main part of the rinsing phase.

3. Filter system according to claim 1 characterized in that the collecting part (34) of the coarse sieve includes a circular wall part and a bottom.

4. Filter sieve according to claim 1 characterized in that coarse sieve (33) is provided with a filtering area (37) serving as a coarse sieve for the circulating liquid when the coarse sieve is in its second position.

5. Filter system according to claim 4 characterized in that the collecting part (34) of the coarse sieve (33) is provided with a circular wall part and a bottom (36) whereas the filtering area (37) area constitutes an extension of the circular wall part below said bottom (36).

6. Filter system according to claim 1 characterized in that said means (29, 31) are activated and/or deactivated by a program control.

7. Filter system according to claim 1 characterized in that the bottom of the wash space (10) is provided with a liquid collecting container (17) divided into a first and a second chamber by means of the fine filter (19), the first chamber communicating with a circulation pump whereas the second chamber is arranged to receive the coarse sieve (33).

8. Filter system according to claim 1 characterized in that said actuating means is placed below the coarse sieve.

9. Filter system according to claim 8 characterized in that said actuating means (29, 31) is a wax actuator.

10. Filter system for a household dishwasher comprising a wash space, the filter system comprising:

a cylinder/piston actuating arrangement and a liquid circuit that comprises a coarse sieve having a collecting part and one or several fine filters, the coarse sieve being movable between a first position and a second position via the cylinder/piston actuating arrangement in the dishwasher wherein when the cylinder/piston actuating arrangement positions the coarse sieve in the first position, the collecting part is positioned within a flow of rinsing liquid such that the rinsing liquid can flow through the coarse sieve, and wherein when the cylinder/piston actuating arrangement positions the coarse sieve in the second position, the collecting part is positioned above the one or several fine filters.

* * * * *